US006154181A

United States Patent [19]

Hu-Guo et al.

[11] Patent Number: 6,154,181

[45] Date of Patent: Nov. 28, 2000

[54] ELECTROMAGNETIC WAVE TRANSMITTER/RECEIVER

[75] Inventors: Chaoying Hu-Guo, Illkirch; Patrice Hirtzlin, Rennes; Gérard Haquet, Betton, all of France; David Harrison, Andover, United Kingdom

[73] Assignee: Thomson Licensing S.A., Boulogne, France

[21] Appl. No.: 09/211,181

[22] Filed: Dec. 14, 1998

[30] Foreign Application Priority Data

Dec. 31, 1997 [FR] France ..... 97 16765

[51] Int. Cl.[7] ..... H01Q 13/00

[52] U.S. Cl. ..... 343/772; 343/771; 343/786; 343/840; 333/21 A

[58] Field of Search ..... 333/21 A, 21 R, 333/126, 135, 137, 248; 343/771, 772, 786, 840, 756, 909, 753

[56] References Cited

U.S. PATENT DOCUMENTS

| | | | |
|---|---|---|---|
| 2,606,248 | 8/1952 | Dicke | 333/21 A |
| 3,668,567 | 6/1972 | Rosen | 333/21 A |
| 4,758,806 | 7/1988 | Möhring et al. | 333/135 |
| 5,517,203 | 5/1996 | Fiedziuszko | 343/756 |
| 5,619,173 | 4/1997 | King et al. | 343/756 |
| 5,796,371 | 8/1998 | Sato et al. | 343/786 |

FOREIGN PATENT DOCUMENTS

| | | | |
|---|---|---|---|
| 552944A1 | 1/1993 | European Pat. Off. | H01P 1/161 |
| 2117980A | 10/1983 | United Kingdom | H01P 1/161 |

OTHER PUBLICATIONS

Patent Abstracts of Japan, vol. 18, No 646 (E–1641), Dec. 8, 1994 & JP 06 252609 (Toshiba Corp.), published Sep. 9, 1994.

Copy of the French Search Report ( in English) citing the above listed documets AA, AL, AM, AN.

*Primary Examiner*—Tan Ho

*Attorney, Agent, or Firm*—Joseph S. Tripoli; Kuniyuki Akiyama

[57] ABSTRACT

A device includes a waveguide for the transmission/reception of microwave signals. The waveguide is coupled to a microstrip reception circuit as well as to a microstrip transmission circuit. The waveguide includes a filter arrangement which attenuates the microwave signals transmitted from the transmission circuit in order to prevent undesirable interference to the reception circuit.

14 Claims, 5 Drawing Sheets

ELECTROMAGNETIC WAVE TRANSMITTER/RECEIVER

FIELD OF THE INVENTION

The invention relates to a device for reception/transmission of electromagnetic waves.

Telecommunication services of the wireless interactive type are developing rapidly. These services relate to telephony, facsimile transmission, television, in particular digital television, the so-called "multimedia" field and the internet network. The equipment for these mass-market services have to be made available at a reasonable cost. This is so, in particular, as regards the user's receiver/transmitter which has to communicate with a server, most often via a telecommunication satellite, or in the scope of an MMDS (Multi-point Multi-channel Distribution System), LMDS (Local Multi-point Distribution System) or MVDS (Multi-point Video Distribution System) system, these being explained in the book "Reference Data for Engineers" SAMS Publishing—Chapter 35, page 20. These communication methods generally use the microwave range. For example, in the scope of the MMDS system, frequency bands of the order of 40 GHz are used.

For these frequency ranges, a waveguide receiver and a waveguide transmitter are customarily used, the two waveguides being separate.

This technology is complicated to use if it is necessary to make a return link from the customer to the base station with a view to conveying a flow of information or instructions from the customer to the source of the service (for example, in the field of audio-visual programmes, pay per view). It is therefore expensive. Furthermore, its weight and its bulk are incompatible with use by private individuals. What is more, it is advantageous to provide isolation between the transmission link and the reception link, and thus to avoid degradation of the reception signal by the transmission signal.

SUMMARY OF THE INVENTION

The invention overcomes the aforementioned drawbacks.

It is characterized in that the device includes a waveguide coupled to a microstrip reception circuit and to a microstrip transmission circuit, said circuits being arranged respectively in a first straight section and a second straight section of said guide, parallel to the first, said guide furthermore including filtering means arranged so that the waves broadcast by said transmission circuit are attenuated enough, at the reception circuit, not to cause interference in said reception circuit.

Such a device employing hybrid microstrip and waveguide technology can be produced at moderate cost. Its bulk and its weight are reduced, and transmission and reception are nonetheless possible simultaneously. What is more, the use of a waveguide makes it possible to profit from a wide frequency band for transmission and reception.

Furthermore, excellent isolation between the transmission and reception signals is obtained in this way.

The invention relates to a system for reception/transmission of electromagnetic waves, including focusing means of said waves, characterized in that it is equipped with a device according to the invention.

BRIEF DESCRIPTION OF THE DRAWINGS

Other advantages of the present invention will emerge from the following description of the illustrative embodiment, taken by way of non-limiting example, with reference to the appended figures in which.

To simplify the description, the same references will be used in the various figures to denote those elements which fulfil identical functions.

Figure 1:
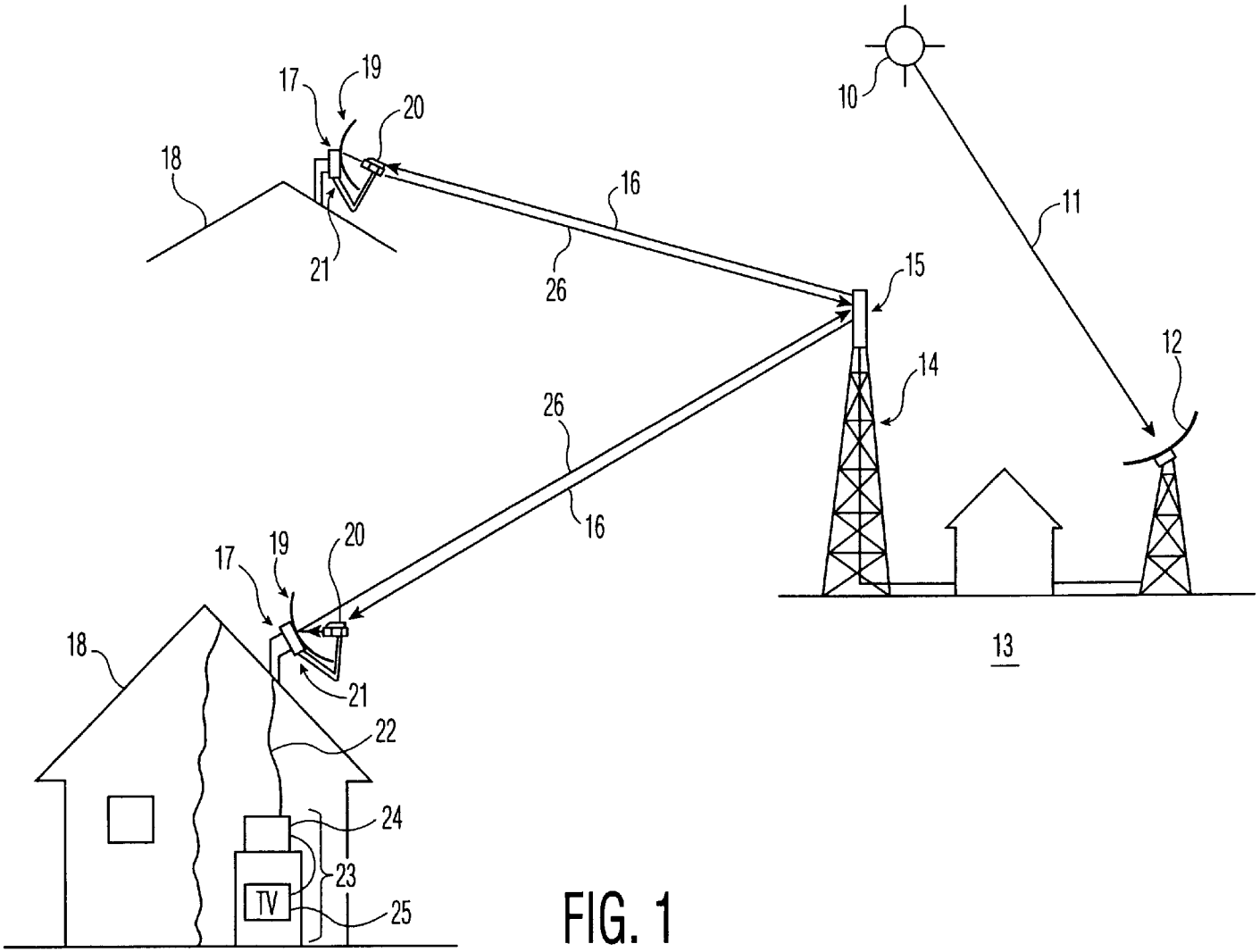
FIG. 1 represents the basic idea of the return link of an MMDS, LMDS or MVDS satellite reception/transmission system employed by the invention.

FIG. 1 represents the basic idea of the return link of an MMDS, LMDS or MVDS reception/transmission system employed by the invention.

The information distributed by the system may come from satellites, a recording studio or cable networks. In the example illustrated in FIG. 1, a satellite 10 sends information 11 to a receiving antenna 12 of a ground station 13. This information 11 is sent to a common antenna 14 provided with a transmitter/receiver 15 which broadcasts the information and programmes made available to customers. For example, the microwave transmitter/receiver 15 broadcasts information 16 in the scope of the MMDS system. This information and these programmes 16 are picked up on the part of each customer by means of a small diameter antenna 17 (of the order of 10 cm for an application in the scope of the 40 GHz MMDS system) placed on the roof of a dwelling 18, for example. Of course, in the case of a block of flats, these antennas may, by virtue of their small size, be placed close to the balconies of the various storeys. The antenna 17 comprises a reflector 19 intended to focus the received energy, a reception/transmission device according to the invention forming a primary source 20 which is accommodated at the focus of the reflector 19 and whose end open to the radiated waves is in the form of a horn or an electromagnetic lens, said device furthermore comprising a frequency converter which converts the down signals coming from the antenna 14 into intermediate frequencies, and the intermediate-frequency signals intended to be transmitted to said antenna 14 into high frequencies. This converter is integrated in the reception/transmission device according to the invention. According to a variant represented in FIG. 2, it may be placed isolated in a frequency conversion device 21. The converter 21 converts the received signals into intermediate frequencies and, via connection means, for example a coaxial cable 22, sends them to an interior unit 23 which is arranged inside the dwelling 18 and comprises a decode/coder 24 connected to means for using the broadcast information, for example a television set 25.

In the invention, said antenna 17 are also used for the return link. Thus, the customer replies, in the scope of an interactive service, for example via a remote control. The information is encoded then sent, by means of the cable 22, to the high-frequency converter which converts said information into a transmission frequency band. A "customer" uplink 26 broadcasts the return data to the ground station 13, which therefore also has the role of collecting and centralizing the data which are broadcast by the customers and are received on its transmitter/receiver 15.

This uplink operates, for example, in the frequency bands [40.5–40.55 GHz] and [42.45–42.5 GHz] for a European 40 GHz MMDS system, while the downlink, denoting the link via which the antenna 17 receives the information broadcast by the transmitter/receiver 14, operates for example in the frequency bands [40.55–41.5 GHz] and [41.5–42.45 GHz].

The data broadcast on the uplink may be data pertaining to pay television, or more generally interactive television which gives the customer immediate access to films, interactive games, teleshopping, software downloading and also services such as database querying, reservations, etc.

Figure 2:
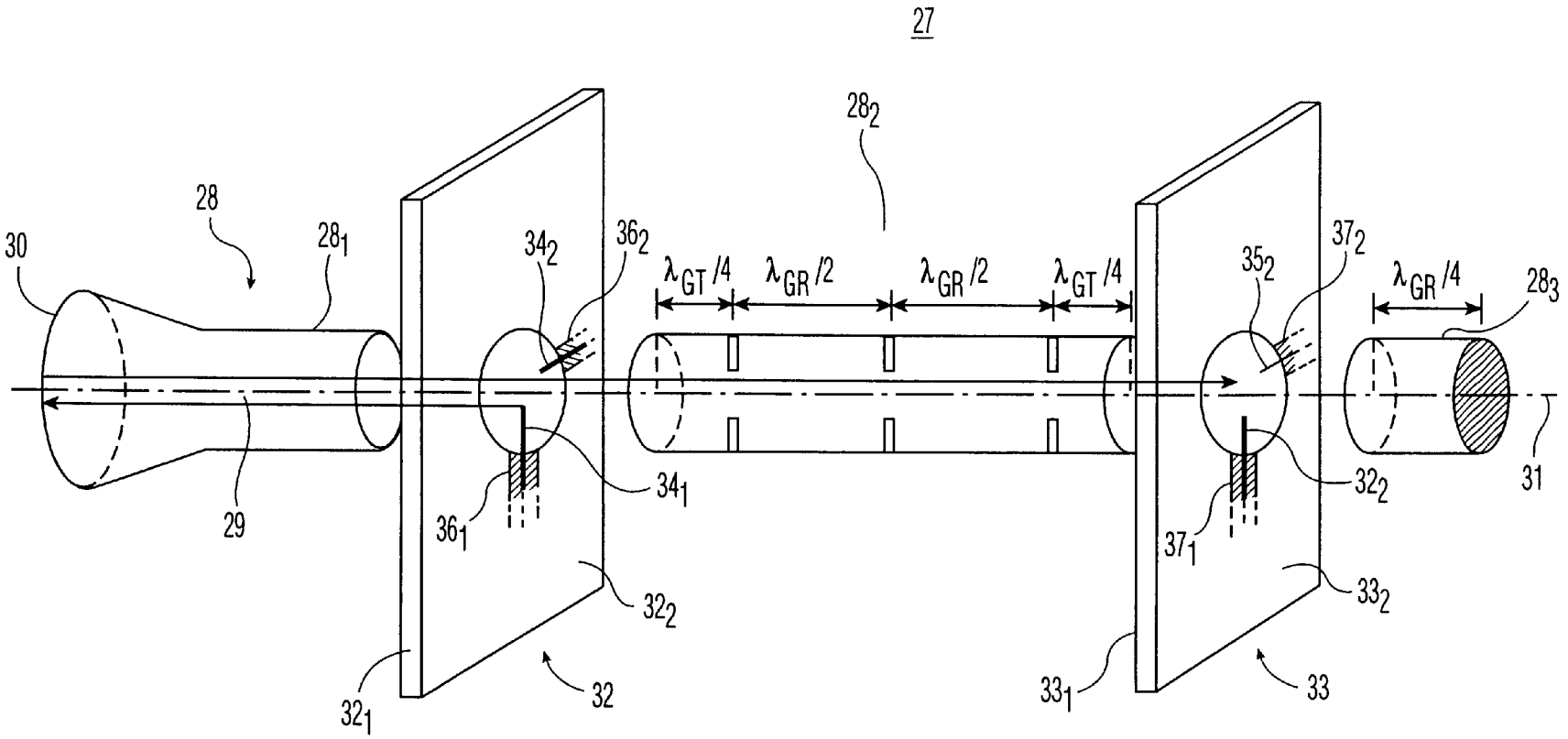
FIG. 2 represents a schematic exploded view of an embodiment of a device according to the invention, FIGS. 3.*a*, 3.*b*, 3.*c*, 3.*d*, 3.*e* schematically represent views of five embodiments of isolation means according to the invention.

FIG. 2 represents a schematic exploded view of an embodiment of a device 27 according to the invention.

It comprises a cylindrical cap 28 whose open end is arranged at the focus 29 of an antenna for reception/transmission of electromagnetic waves (the antenna is not shown in FIG. 2). The open end of the cap 28 extends in a frustoconical part or horn 30 which has discontinuities or grooves allowing good reception/transmission of said waves. These discontinuities (not shown) are known per se. The cap 28 of the waveguide is separated into three parts $\mathbf{28}_1$, $\mathbf{28}_2$ and $\mathbf{28}_3$. The part $\mathbf{28}_1$ is connected to the horn 30, the part $\mathbf{28}_2$ is the central part of the cylindrical cap 28 and the part $\mathbf{28}_3$ is the end part of the guide, comprising a resonant cavity. Between the first and the second guide parts $\mathbf{28}_1$ and $\mathbf{28}_2$, a microstrip circuit board 32, for transmitting the electromagnetic waves, is arranged transversely with respect to a principle axis 31 of the guide 28, and between the second and third guide parts $\mathbf{28}_2$ and $\mathbf{28}_3$, a microstrip circuit board 33 for receiving electromagnetic waves is arranged transversely with respect to the axis 31. These two boards 32 and 33, each forming a substrate, consist of a material which has a given electrical permittivity and is known per se. Said boards 32 and 33 have respective upper surfaces $\mathbf{32}_1$, $\mathbf{33}_1$ turned towards the space where the energy is to be radiated or picked up, and a lower surface $\mathbf{32}_2$, $\mathbf{33}_2$ arranged on the other face of the substrate. The lower surfaces $\mathbf{32}_2$, $\mathbf{33}_2$ are metallized, forming a ground plane, and are in contact with the conductive walls of the guide 28. The boards 32 and 33 are respectively supplied by two probes $\mathbf{34}_1$, $\mathbf{34}_2$ and $\mathbf{35}_1$, $\mathbf{35}_2$ which are respectively etched on the upper surfaces $\mathbf{32}_1$, $\mathbf{33}_1$ of the boards 32, 33 and which penetrate inside the perimeter of the guide 28 through openings, without touching the wall of the guide 28. In order to make it possible to receive and transmit orthogonally polarized waves, the two probes of each of the pairs ($\mathbf{34}_1$, $\mathbf{34}_2$) and ($\mathbf{35}_1$, $\mathbf{35}_2$) are arranged at right angles to one another. These two probes ($\mathbf{34}_1$, $\mathbf{34}_2$), and the probes ($\mathbf{35}_1$, $\mathbf{35}_2$), respectively, are connected on the board 32, and the board 33, respectively, by microstrip lines ($\mathbf{36}_1$, $\mathbf{36}_2$), and $\mathbf{37}_1$, $\mathbf{37}_2$), respectively, whose technology is known per se, to a transmission circuit, and to a reception circuit, respectively, these circuits being shown in detail in FIG. 5. The device 27, including the frequency conversion devices for the two links, is connected to the interior unit 23 located inside the dwelling 18 (these are not shown).

The guide part $\mathbf{28}_3$ closing the guide 28 is a quarter-wave $\lambda_r/4$ guide section which forms a resonant cavity and operates as an open circuit in the plane of the substrate 33 for the received waves, $\lambda_{GR}$ representing the wavelength of the received wave. In contrast, the guide part $\mathbf{28}_2$ is an electromagnetic filter making it possible to isolate the probes $\mathbf{35}_1$, $\mathbf{35}_2$ from the energy losses due to the waves broadcast by the probes $\mathbf{34}_1$, $\mathbf{34}_2$.

FIGS. 3*a*, 3*b*, 3*c*, 3*d*, 3*e* schematically illustrate the various embodiments of electromagnetic filters making it possible to receive waves without suffering the effects of interference due to the radiation from the probes $\mathbf{34}_1$, $\mathbf{34}_2$.

The technique of such electromagnetic filters is explained in the encyclopaedia "Techniques de I'lngénieur" [Engineering Techniques] volume E-3-II E3250 chapter 2, entitled "filtres hyperfrequences" [microwave filters]. In waveguides, a resonant cavity can be produced by placing two reactive elements at a determined distance from one another.

Figure 3A:
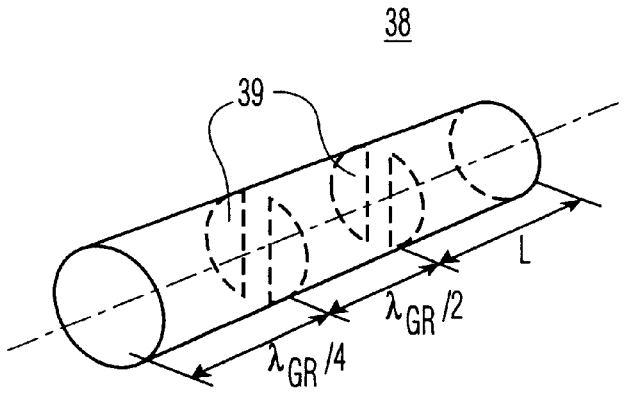

FIG. 3*a* represents a bandpass filter 38 using several resonant cavities coupled inductively by irises 39. The distance between two consecutive irises 39 in the length direction of the guide 28 is chosen so that the reflections between the two irises cancel each other out at the resonant frequency of the cavity. This distance is of the order of $\lambda_{GR}/2$, $\lambda_{GR}$ being the guided wavelength of the frequencies received by the probes $\mathbf{35}_1$, $\mathbf{35}_2$. The bandpass filter 38 produced in this way, furthermore having a quarter-wave $\lambda_{GT}/4$ guide section at its input, $\lambda_{GT}$ being the wavelength of the frequencies broadcast by the probes $\mathbf{34}_1$, $\mathbf{34}_2$, can be considered as an open circuit for the energy radiated by said probes $\mathbf{34}_1$, $\mathbf{34}_2$ in the plane of the substrate 32, and does not filter for the received-frequency band. It has been deemed expedient to introduce several successive cavities separated by irises 39, this making it possible to improve the frequency response of the filter 38 while having a sharper cutoff. By way of explanation, as the number of irises 39 increases, the frequency response of the filter 38 becomes steeper. In view of the compromise between the performance which is obtained by increasing the number of irises 39 and the complexity which may result from this, it is preferable to use a filter 38 having between 2 and 3 irises 39. It should be noted that the distance l separating the last iris in the board 33 is arbitrary, this being true for the filters below.

Figure 3B:
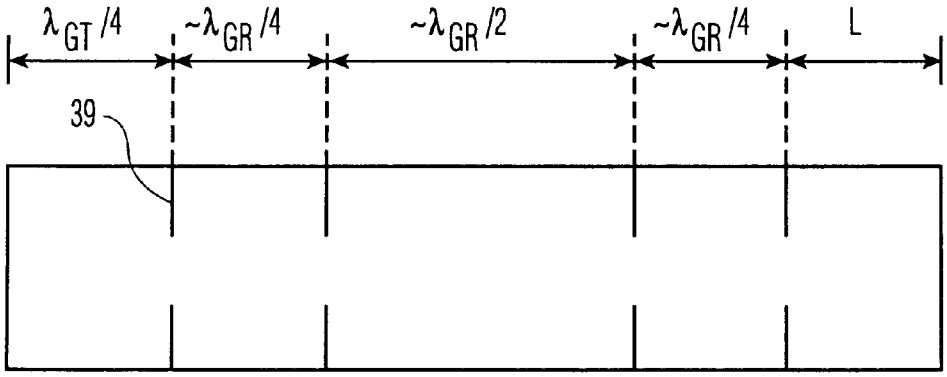

FIG. 3*b* represents a plan view of a horizontal section of an alternative of the bandpass filter 38.

Figure 3C:
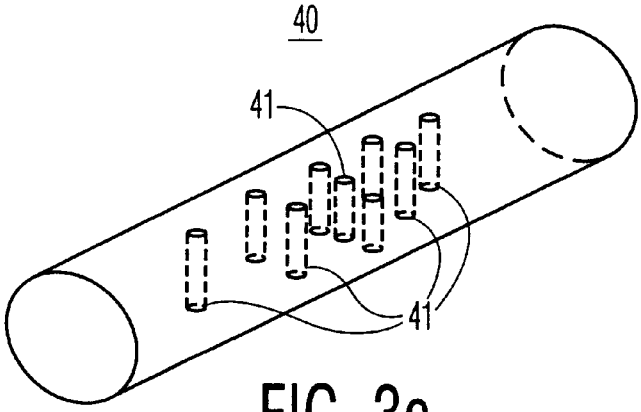

FIG. 3*c* represents a bandpass filter 40 produced using a succession of screws 41. In order to allow fine adjustment of the resonant frequency of each cavity to be made, these screws 41, which have variable insertion and behave as capacitive susceptances, are placed so as to make it possible to optimize the setting of the filter 40.

Figure 3D:
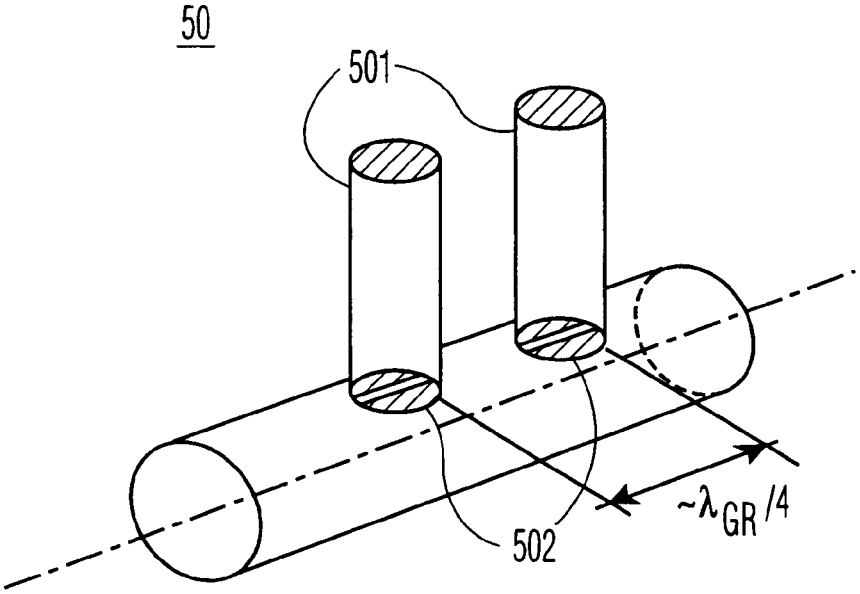

FIG. 3*d* represents a notch filter 50. This filter 50 is produced using resonant cavities 501 which are connected transversely to the body of the guide $\mathbf{28}_2$ by coupling with irises 502. The distance between these cavities is of the order of one quarter of the guided wavelength of the waves broadcast by the probes $\mathbf{34}_1$ and $\mathbf{34}_2$.

Figure 3E:
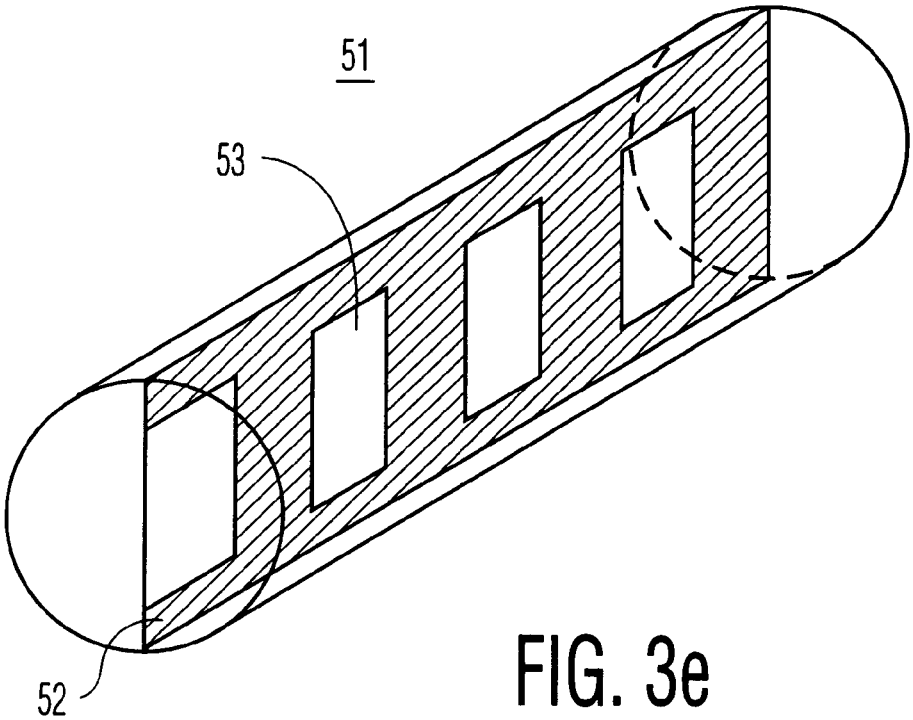

FIG. 3*e* represents a bandpass filter 51 called a finline. These filters 51 are easy to produce by inserting a metallized substrate 52, which has windows 53, in the E plane of the rectangular waveguide. A metal plate having an identical geometry to said substrate 52 may also be used.

FIG. 4 represents a block diagram of embodiments of frequency conversion circuits respectively present in the microstrip reception and transmission circuits according to the invention.

Figure 4A:
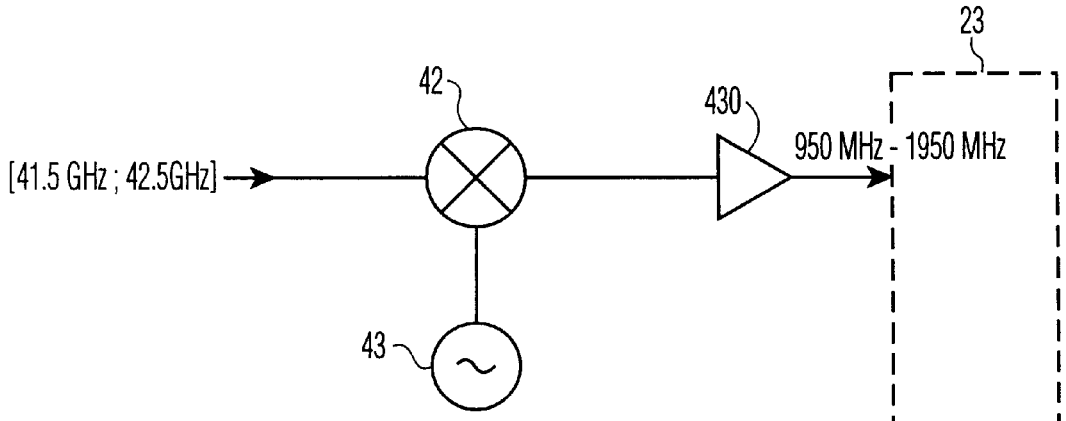
FIG. 4 represents a block diagram of embodiments of frequency conversion circuits respectively present in the microstrip reception and transmission circuits according to the invention. More particularly, FIG. 4.*a* represents the simplified diagram of the reception circuit connected to the reception probes, while FIG. 4.*b* represents the simplified diagram of the transmission circuit of the device according to the invention connected to the transmission probes.

FIG. 4*a* represents the simplified diagram of the reception circuit connected to the probes $\mathbf{35}_1$, $\mathbf{35}_2$. In the present embodiment, said reception circuit receives in the band [41.5 GHz; 42.45 GHz]. This band, like any numerical value cited, should of course be considered only as an example to clarify the description, and cannot constitute a limitation in the scope of the present patent application.

The signals received on the probes $35_1$, $35_2$ are sent to a mixer 42, a second input of which is connected to an oscillator 43 at the frequency 40.55 GHz. The output of the mixer 42 is connected to an input of a low-noise amplifier 430 whose output delivers a signal whose intermediate frequency band is [950 MHz; 1950 MHz] and which is connected to the interior unit 23 by the cable 22.

Figure 4B:
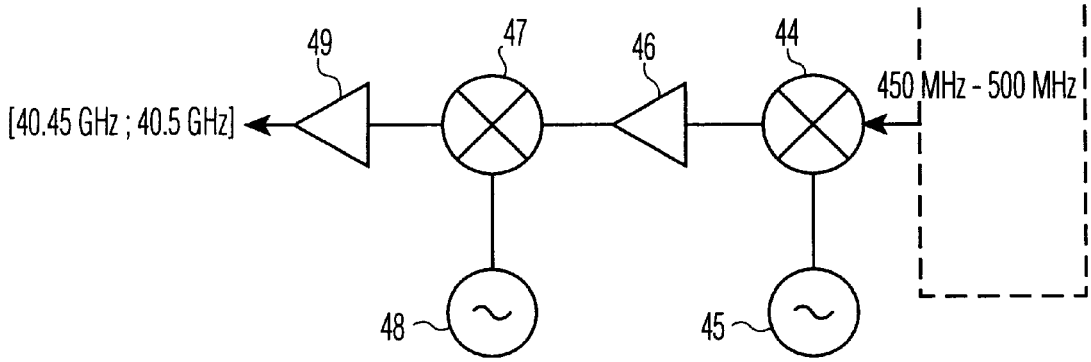

FIG. 4*b* represents the simplified diagram of the transmission circuit of the device 27 connected to the probes $34_1$, $34_2$. The frequency band of the intermediate signals coming from the interior unit 23 is [450 MHz; 500 MHz]. These signals are applied to a first mixer 44, a second input of which is connected to an oscillator 45 at the frequency 2.4 GHz and whose output is connected to an input of a low-noise amplifier 46. The output of the latter is applied to a mixer 47, a second input of which is connected to an oscillator 48 at the frequency 37.6 GHz. The output of this mixer 47 is connected to an amplifier 49 whose output delivers the signals for transmission to the probes $34_1$, $34_2$ in the frequency band [40.45 GHz; 40.5 GHz].

Various other configurations may clearly be envisaged in the established frequency plane, for example:

a reception band [40.55 GHz; 41.5 GHz] and a transmission band [42.45 GHz; 42.5 GHz], a reception band [41.5 GHz; 42.45 GHz] and a transmission band [40.5 GHz; 40.55 GHz].

At these high reception/transmission frequencies, current filters need to be provided with a frequency space of about one gigahertz between the reception band and the transmission band. The various frequency plane configurations, as well as others which have not been mentioned, need to satisfy this condition.

According to a variant of the invention, the reception/transmission system according to the invention may comprise an electromagnetic lens with the device 27 according to the invention arranged substantially at its focus 29.

The device 27 according to the invention operates as follows:

The electromagnetic waves arriving on the antenna 19 are focused at its focus to be guided along the guide 28. These waves pass through the filter $28_2$, which may be a bandpass filter allowing only the reception frequency band through, a notch filter cutting off the transmission frequency band or a highpass filter, or lowpass filter, respectively, in the case when the transmission band is chosen, in the frequency plane, so that the transmission frequencies are lower, or higher, respectively, than the reception frequencies. Said waves are then received and picked up by the probes $35_1$, $35_2$ which deliver to the frequency conversion circuit, for example the one in FIG. 4*a,* a reception signal which, after conversion to intermediate frequencies, is intended to be sent to the interior unit 23.

Simultaneously, the signals coming from said unit 23 pass through the frequency conversion circuit, for example the one in FIG. 4*b,* and supply the probes $34_1$, $34_2$ with the waves for broadcasting to the source antenna 29. The energy radiated by these probes on the filter $28_2$ side is attenuated, or fully filtered, so that the leaks of the transmitted waves are small enough not to cause interference in the reception circuit. By way of example, the interference will be considered to be negligible if the waves broadcast by the probes $34_1$, $34_2$ are attenuated to 70 dB below their initial level during transmission.

Of course, the invention is not limited to the embodiment which has been described and represented, which was only given by way of example. Thus, the guide may be of any shape allowing good reception/transmission of the electromagnetic waves. By way of example, the guide may be rectangular if one polarization is favoured over another. Similarly, the axis of the guide may be bent. The horn 30 may furthermore be of any kind, for example a grooved horn, or may be replaced by an electromagnetic lens.

What is claimed:

1. Device for reception/transmission of electromagnetic waves, characterized in that it includes a waveguide (28) coupled to a microstrip reception circuit (33) and to a microstrip transmission circuit (32), said circuits (32, 33) being arranged respectively in a first straight section and a second straight section of said waveguide (28), parallel to the first section, said waveguide furthermore including filtering means arranged so that the waves broadcast by said transmission circuit (32) are attenuated enough, at the reception circuit (33), not to cause interference in said reception circuit (33).

2. Device according to claim 1, characterized in that the transmission circuit (32) is arranged upstream of the reception circuit (33) in the direction in which said waves are received.

3. Device according to claim 1, characterized in that said filtering means comprise a waveguide cavity filter $(28_2)$ arranged between said transmission (32) and reception (33) circuits.

4. Device according to claim 1, characterized in that said filtering means comprise a filter (38) with resonant cavities, each cavity being of length $\lambda_{GR}/2$ and placed between at least two irises (39), said filter (38) being intended to form a bandpass filter substantially centred on the frequency of the wave received by the reception circuit (33).

5. Device according to claim 1, characterized in that said filtering means comprise a screw (41) cavity filter (40), said filter (40) being intended to form a bandpass filter substantially centred on the frequency of the wave received by the reception circuit (33).

6. Device according to claim 1, characterized in that said filtering means comprise a filter (50) with resonant cavities which is formed by at least two resonant cavities (501) that are connected transversely to the body of the waveguide cavity filter by coupling with irises (502) and are spaced apart by $\lambda_{GT}/4$, which is intended to form a notch filter substantially centred on the frequency of the wave transmitted by the transmission circuit (32).

7. Device according to claim 1, characterized in that said filtering means comprise a filter (51) of the finline type, comprising at least one resonator produced on a metallized substrate (52) or a slotted metal plate inserted in the E plane of the waveguide, which is intended to form a bandpass filter substantially centred on the frequency on the wave received by the reception circuit.

8. Device according to claim 1, characterized in that it includes two reception probes $(35_1, 35_2)$, and two transmission probes $(34_1, 34_2)$, respectively, which are arranged on the reception circuit (33), and on the transmission circuit (32), respectively, are at right angles to one another and can receive, and transmit, respectively, orthogonally polarized waves.

9. Device according to claim 8, characterized in that the reception probes $(35_1, 35_2)$, and the transmission probes $(34_1, 34_2)$, respectively, are etched on the substrate of the microstrip reception circuit (33), and the microstrip transmission circuit (32), respectively.

10. Device according to claim 1, characterized in that each microstrip circuit (33, 32) includes a frequency conversion circuit.

11. Device according to claim 1, characterized in that said waveguide (28) is closed by a quarter-wave ($\lambda_{GR}/4$) cavity ($\mathbf{28}_3$) whose length is equal to one quarter of the guided wavelength ($\lambda_{GR}$) of the received wave.

12. System for reception/transmission of electromagnetic waves, including wave focusing means, characterized in that it is equipped with a device according to claim 1.

13. System according to claim 12, characterized in that said focusing means include a parabolic reflector, and in that said device is arranged substantially at the focus (29) of said parabolic reflector (19).

14. System according to claim 12, characterized in that said focusing means include an electromagnetic lens, and in that said device is arranged substantially at the focus (29) of said electromagnetic lens.

* * * * *